United States Patent [19]

Knapp

[11] 4,198,010

[45] Apr. 15, 1980

[54] HOSE WINDING APPARATUS

[76] Inventor: Orville J. Knapp, 3255 Darley, Boulder, Colo. 80303

[21] Appl. No.: 952,995

[22] Filed: Oct. 20, 1978

[51] Int. Cl.[2] ..... B65H 75/40

[52] U.S. Cl. ..... 242/86.2

[58] Field of Search ..... 242/86, 86.1, 86.2, 242/60, 180; 137/355.16, 355.19, 355.26, 355.27

[56] References Cited

U.S. PATENT DOCUMENTS

| | | | |
|---|---|---|---|
| 394,556 | 12/1888 | Coleman | 242/86.2 |
| 3,124,321 | 3/1964 | Rylott | 242/86.2 |
| 4,057,198 | 11/1977 | Whitfield | 242/86.2 |

*Primary Examiner*—Edward J. McCarthy

*Attorney, Agent, or Firm*—Ancel W. Lewis, Jr.

[57] ABSTRACT

Apparatus for winding canvas fire hose or the like into a compact coil comprising a rotatably mounted winding disc for coiling the hose, an electric drive assembly for rotating the winding disc, and a mobile base with an offset leg arrangement for supporting the winding disc and drive assembly. The winding disc is mounted for rotation about a generally horizontal rotational axis and is provided with two support members in the form of a flat support plate and an offset guide pin for supporting a coupling end of the hose while the hose is coiled around the coupling by rotation of the disc. Once a hose has been coiled it can be bound and easily removed from the winding disc.

13 Claims, 6 Drawing Figures

HOSE WINDING APPARATUS

FIELD OF THE INVENTION

This invention relates to equipment for handling fire hose or the like and more particularly to a new and improved hose winding apparatus especially adapted for winding canvas hose into compact coils.

BACKGROUND OF THE INVENTION

Canvas fire hose is generally dried after each use and then folded or coiled into a compact roll for transport or storage. If the hose is folded or coiled by hand it is a backbreaking and time consuming operation that often requires the cooperation of several men. Various reels and winders have heretofore been proposed to aid in folding or winding fire hose. U.S. Pat. No. 3,168,260 for instance, discloses a reel that can be hand cranked for winding fire hose into a coil, which can then be bound and removed from the reel. U.S. Pat. No. 3,254,862 discloses a horizontally mounted motor driven reel that also winds hose into a compact coil. U.S. Pat. No. 3,254,862 discloses a motor driven hose folder that folds hose into a compact bundle.

In general, a problem with these prior art hose winders is that they are not suitable for winding large diameter or relatively heavy, double jacket hoses. In addition, these prior art winders may be difficult for one man to operate and generally lack the portability to be utilized in field operations.

The hose winder of the present invention on the other hand, can be utilized with single jacket hose ranging in diameter from 1½" to 5" or double jacket hose up to 3 inches in diameter without any adjustments to the machine. In addition, the present hose winder is highly mobile for use in field operations and has a novel arrangement for supporting a coupling end of the hose while the hose is coiled around the coupling.

Accordingly, it is an object of the present invention to provide a simple and inexpensive apparatus for winding fire hose or the like into compact coils.

Another object of the present invention is to provide an electrically powered hose winder apparatus capable of handling different diameter hose without adjustments to the machine.

Yet another object of the present invention is to provide a highly mobile hose winder apparatus suitable for field operations.

SUMMARY OF THE INVENTION

Apparatus for winding fire hose or the like into a compact coil comprising a winding disc rotatably mounted for coiling the hose, a drive assembly, preferably electric, for rotating the winding disc and a mobile support base for supporting the winding disc and drive assembly. The winding disc generally comprises a flat circular disc mounted for rotation about a generally horizontal axis and is provided with two support members for supporting a coupling end of the hose while the hose is coiled around the coupling. A flat support plate supports the coupling itself and an offset retaining pin allows the hose to be looped around the coupling for forming a coil. In operation, the female coupling of the hose is placed between the support plate and offset guide pin with a portion of the hose looped around the guide pin and coupling, and the winding disc is rotated by operation of the electric drive. As the winding disc rotates the operator guides the hose along the front surface of the disc into a coil around the coupling. The coil can then be bound and removed from the support plate and guide pin on the winding disc.

Other objects, advantages and capabilities of the present invention will become more apparent as the description proceeds, taken in conjunction with the accompanying drawings in which like parts have similar reference numerals and in which.

DESCRIPTION OF THE PREFERRED EMBODIMENTS

Figure 1:
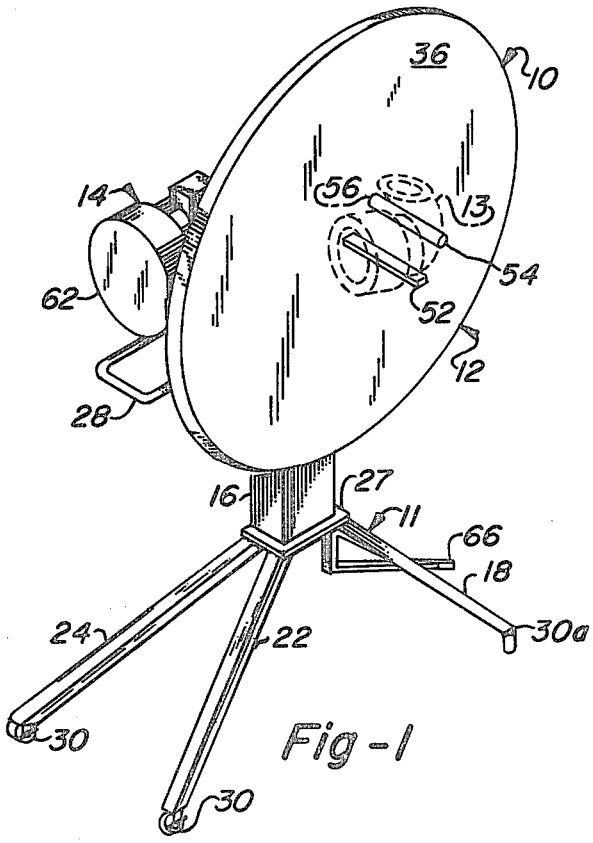
FIG. 1 is a perspective view of a hose winder apparatus constructed in accordance with the invention.

Referring now to FIG. 1, the hose winder apparatus 10 shown and generally stated, comprises, a portable support base 11, winding means in the form of a circular winding disc 12 for coiling lengths of canvas hose 13 into compact coil, and drive means in the form of a drive assembly 14 for rotating the winding disc 12.

Figure 3:
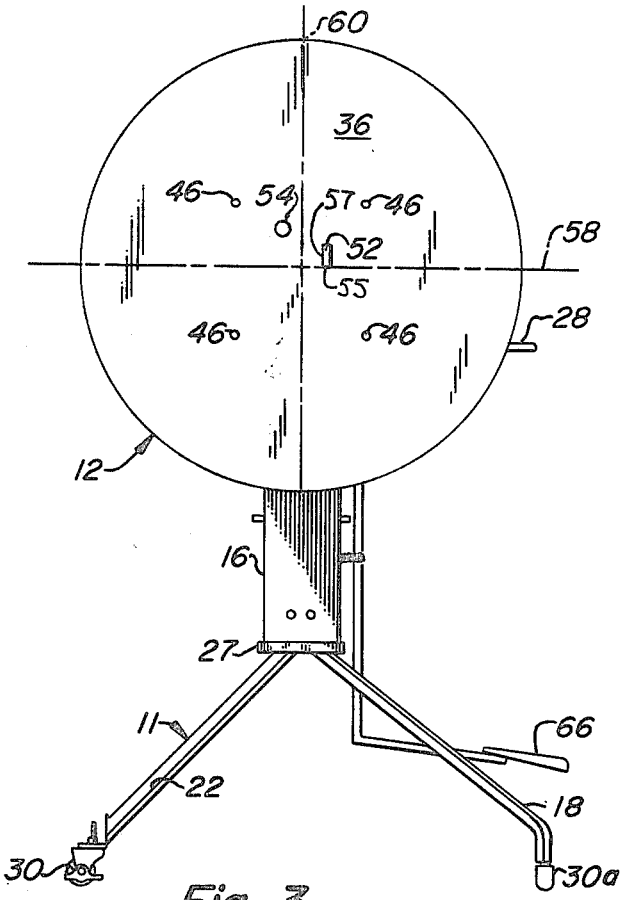
FIG. 3 is a front elevation view of the hose winder apparatus shown in FIG. 1.
Figure 4:
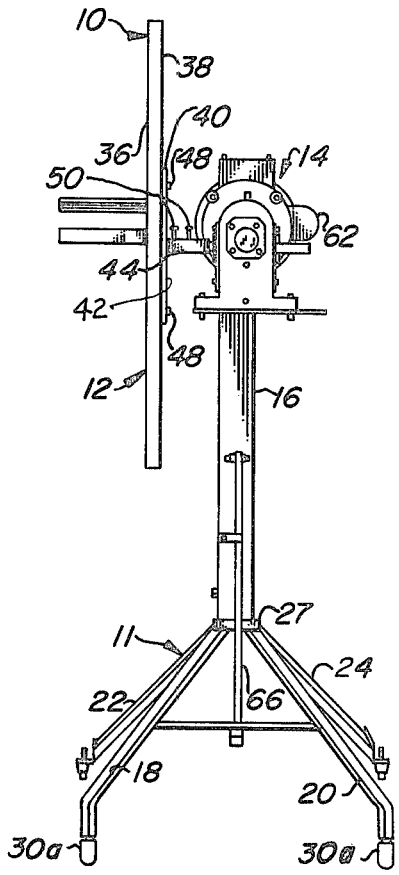
FIG. 4 is a side elevation view of the hose winder apparatus shown in FIG. 1.
Figure 5:
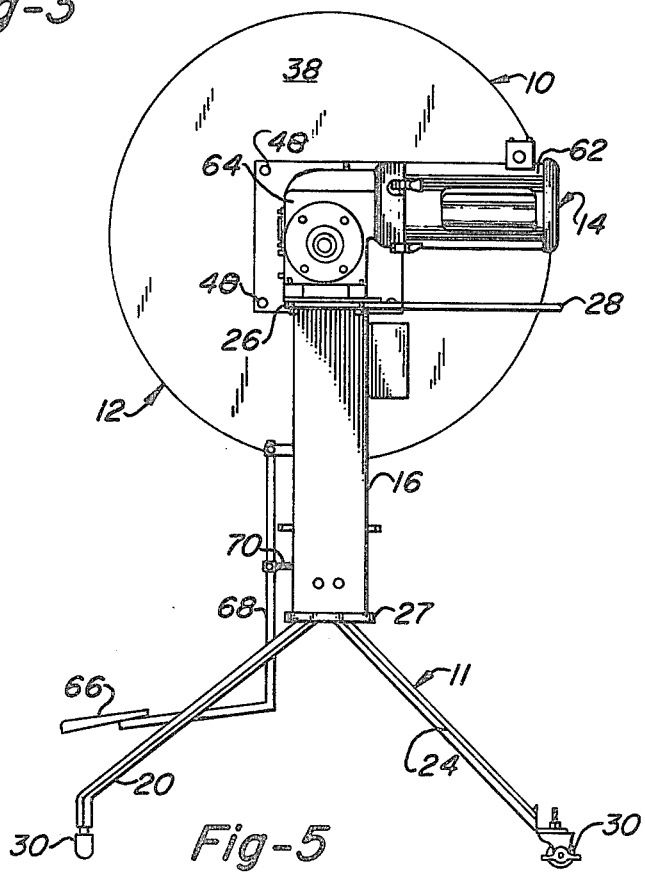
FIG. 5 is a rear elevation view of the hose winder apparatus shown in FIG. 1.

As shown in FIGS. 3, 4, and 5 the portable support base 11 of the hose winder apparatus 10 comprises a center support 16 and four offset support legs 18, 20, 22 and 24. The center support 16 has a generally rectangular cross sectional configuration and may be fabricated from structural rectangular tubing or the like. A generally rectangular reducer mounting plate 26 (FIG. 5) is attached to the center support 16 at the top of the support for mounting the electric drive assembly 14. Another generally rectangular leg mounting plate 27 is attached to the center support 16 at the bottom of the support for mounting the four support legs 18, 20, 22 and 24. In addition, a handle 28 is attached to the upper end of the center support 16 to aid in moving and positioning the hose winder apparatus 10.

Figure 6:
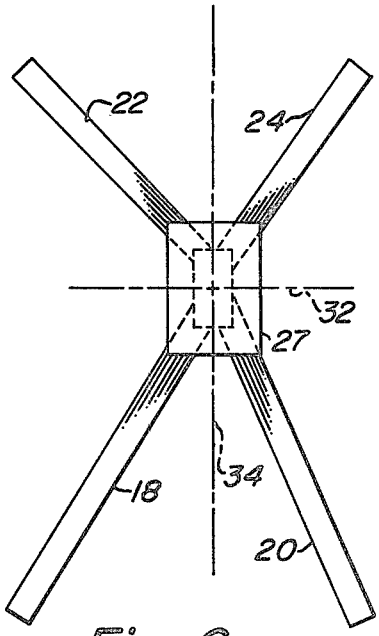
FIG. 6 is a top view with parts removed showing placement of the support legs of the hose winder apparatus shown in FIG. 1.

The support legs 18, 20, 22 and 24 are also generally rectangular in cross section and are mounted on casters 30. The support legs 18, 20, 22 and 24 are offset from the center of the apparatus located at unequal distances from the center of the leg mounting plate 27 and center support 16 of the base. As shown in FIG. 6, the longer support legs 18 and 20 are spaced from a center line 32 of the mounting plate 27 at a distance greater then support legs 22 and 24. The longer support legs 18 and 22 then are on the feed side of the winding disc 12. In one form of the invention the distance from center line 32 of the support plate 27 to the outer edge of legs 18 and 20 is approximately 18 inches and the distance from the center line 32 to the outer edge of legs 22 and 24 is approximately 12 inches. Likewise, support legs 18 and 22 on the disc side of support plate 27 are spaced from a center line 34 of the support plate 27 at a distance greater than support legs 20 and 24 which are opposite the disc side of the support plate 27. In one form of the invention the distance from the center line 34 to the outer edge of legs 18 and 22 is approximately 11 inches and the distance from the center line 34 to the outer edge of legs 20 and 24 is approximately 8 inches. As will hereinafter be explained this offset leg arrangement helps stabilize and balance the hose winder during its operation. Shorter legs 22 and 24 opposite the feed side have casters 30 and longer legs 18 and 20 have feet 30*a*.

Referring now to FIG. 3, the winding disc 12 of the hose winding apparatus 10 is shown and generally comprises a flat disc having a circular outer peripheral configuration with a flat, imperforate planar front side 36 and a flat, imperforate planar rear side 38. The front side 36 of the winding disc 12 is finished with a smooth surface and as will hereinafter be explained acts as a guide surface for coiling the firehose 13 (FIG. 2) on the winding disc 12. The winding disc 12 may be fabricated from finished wood or like material.

A hub 40 (FIG. 4) is attached to the rear side 18 of the winding disc 12 for coupling the winding disc to the output shaft of the electric drive assembly 14. The hub 40 comprises a flat hub mounting plate 42 and a cylindrical shaft coupling 44 attached to the hub mounting plate 42. The hub mounting plate 42 has a generally square peripheral configuration and is attached to the rear side 38 of the winding disc concentric to the winding disc 12 with four capscrews 46 (FIG. 3) countersunk into the front side 16 of the winding disc. Four nuts 48 are attached to the capscrews 46. The shaft coupling 44 of the hub 40 is cylindrical in shape and is provided with an interior bore for receiving the output shaft of the electric drive assembly 14. A pair of setscrews 50 are threaded to tapped holes in the hub for securing the hub 40 to the output shaft of the electric drive assembly 14. With this arrangement the winding disc 12 is rotatable by the electric drive assembly 14 about a generally horizontal rotational axis.

Referring now to FIG. 3, the front side 36 of the winding disc 12 shown is provided with two support members for retaining a coupling end of the hose while the hose is wound into a coil around the coupling. The support members shown comprise a flat generally rectangular shaped support plate 52 and an offset generally cylindrically shaped guide pin 54. Both the support plate 52 and guide pin 54 are offset from the axis of rotation of disc 12 and are attached to the winding disc 12 approximately perpendicular to the plane of the front side 16 of the disc. The support plate 52 is located with its lower edge surface 55 along the horizontal axis 58 of the winding disc 12 and its side edge surface 57 offset a distance from the vertical axis 60 of the winding disc 12. In one form of the invention the support plate 52 has a cross section of approximately 1"×½" and is spaced from the vertical axis 60 of the winding disc 12 by a distance of approximately 1".

Figure 2:
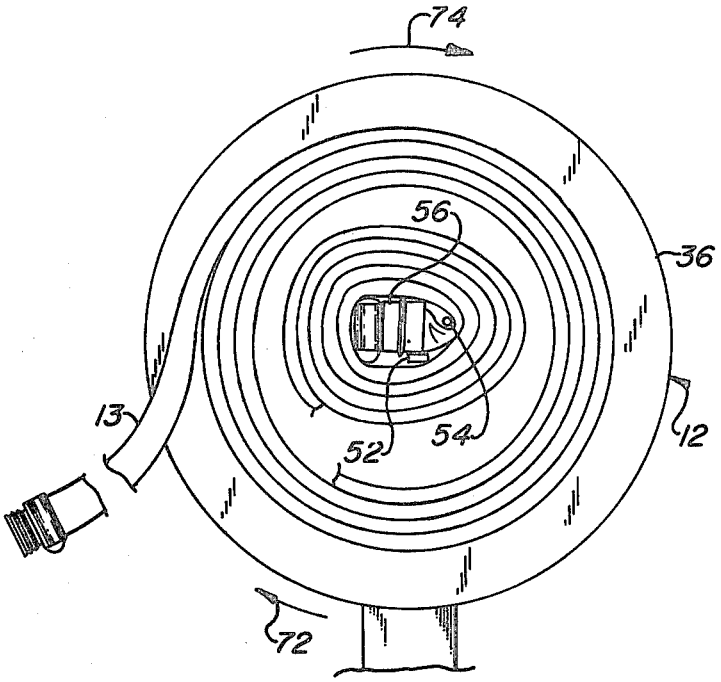
FIG. 2 is a side elevation view of a winding disc of the hose winder apparatus of FIG. 1.

The cylindrical guide pin 54 is located on the winding disc 12 spaced apart and laterally axially offset from the support plate 52. In addition, the guide pin is offset a distance from both the horizontal 58 and vertical 60 axis of the winding disc. In one form of the invention the cylindrical guide pin 54 has a diameter of ½". The pin 54 has a centerline that is offset from the horizontal axis of the winding disc by a distance of approximately 2" and from the vertical axis 60 of the winding disc by approximately 1". With this arrangement, as shown in FIGS. 1 and 2, a coupling 56 (preferably the female coupling of the hose) can be placed on the support plate 52 positioned approximately in the center of the winding disc and the hose 13 is looped around the cylindrical guide pin 54 to begin a coil. Upon rotation of the winding disc the retained hose is coiled around the coupling. In addition, with this arrangement a hose once coiled can be easily withdrawn from the winding disc by pulling the coil over the free ends of members 52 and 54.

Referring now to FIGS. 4 and 5 the electric drive assembly 14 for rotating the winding disc 12 generally comprises an electric motor 62 and a reducing gear box 64 coupled to the electric motor. The electric motor 62 may be a conventional low horsepower 60 amp 110 volt motor although it is understood that other prime movers may be used. In one form of the invention the motor 62 is a ¼ HP, 1750 RPM electric motor. The motor 62 has a conventional electric control circuit with a run-stop switch suitably attached to a foot pedal 66 shown on the feed side of the disc 12. Foot pedal 66 is pivotally mounted on a linkage 68 attached to center support 16 of the support base. A compression spring 70 biases the foot pedal 66 for normally holding the run-stop switch in an open stop position. Depression of the foot pedal 66 throws the run-stop switch for starting the electric motor 62.

The reducing gear box 64 is coupled to the face of the electric motor 62 and is mounted on the reducer mounting plate 26 of the support base. In one form of the invention the gear box 64 is a conventional reducer having a reduction ratio of approximately 60 to 1. The output shaft of the reducing gear box 64 is coupled to the hub 40 of the winding disc 12 and supports the disc for rotation about a generally horizontal axis.

For operating the hose winder apparatus 10 shown, the female coupling 56 of the length of hose 13 is placed on the support plate 52 and a portion of hose 13 is looped around the cylindrical guide pin 54 to begin a coil around the coupling 56. The operator, who is stationed on the feed side of the disc 12, then depresses the foot pedal 66 starting the electric motor 62 for rotating the winding disc. The hose is then coiled around the coupling 56 to wind from the bottom as the winding disc 12 is rotated by the drive assembly. Arrows 72 and 74 in FIG. 2 indicate the direction of motion of the winding disc 12. As the operator guides the hose 13 into a coil around the coupling 56 the flat front side 36 of the winding disc can be utilized as a guide surface to guide the hose into an aligned coil. In addition, in order to form a compact coil the operator may pull on the hose to tension and tighten the coil. The location of the cylindrical guide pin 54 with respect to the support plate 54 helps maintain the coupling 56 in a stationary position while the hose is pulled. Once a compact coil is formed the operator can bind the coil with a cord or the like and remove the coupling 56 along with the coil from the support plate 52 and cylindrical guide pin 54.

During operation of the winding disc the casters 30 on the support legs 22 and 24 can be positioned in opposite directions as shown in FIGS. 3 to prevent the hose winder from moving. In addition, the offset legs 18 and 22 of the support base are longer and positioned to help prevent the hose winder 10 from tipping under the added weight of the hose on the winding disc 12 and longer legs 18 ar d 20 compensate for the tension applied by the operator to the hose in guiding the hose into a coil. Since the base is mobile the apparatus can be easily moved and transported to other locations for field operations.

Although the present invention has been described with a certain degree of particularity, it is understood that the present disclosure has been made by way of example and that changes in details of structure may be made without departing from the spirit thereof.

What is claimed is:

1. Apparatus for coiling a hose assembly or the like including a generally cylindrical coupling with a sidewall and an end to which a hose is attached, said apparatus comprising:

a disc with a substantially flat surface portion mounted for rotation about a rotational axis;

first and second support members attached to and projecting away from said surface portion, said first support member having a flat support surface spaced a first selected distance away from and arranged substantially parallel to a first reference line in the plane of said surface portion passing through said axis to provide a shelf-like support on which the sidewall of the coupling is positioned for support, said first support member projecting away from and substantially delimited in extent in one direction to a second reference line perpendicular to said first reference line in the plane of said surface portion and passing through said axis, said second support member spaced a second selected distance away from said axis along said first reference line and on the opposite side of said first reference line from that of said support surface to provide a stop for the end of the coupling to which the hose is attached and so that said support members form an essentially right-angle seat for the sidewall and end of the coupling, said first support member leading said second support member during the rotation of said disc, whereby, when the coupling is placed on said support surface and the hose extends between said first and second support members, as soon as a pull is exerted on said hose due to the rotation of said disc, said coupling becomes seated in said seat and is held firmly in a right-angle supported position by said support members and said hose first wraps around said second support member, around said coupling and then around said first support member and is guided along said surface portion to form a flat coil; and drive means for rotating said disc.

2. Apparatus as defined in claim 1 wherein the feed side of said disc moves in a downward direction to wind from the bottom of said disc.

3. Apparatus as defined in claim 2 wherein said disc is mounted on a support base having four support legs, two of said support legs on the feed side of said disc being longer than two other of said support legs opposite the feed side of said disc for compensating for the pull on said support base during the winding of said hose on said disc.

4. Apparatus as defined in claim 2 wherein said disc is mounted on a support base having four support legs, two of said support legs on the disc side of said support base being longer than two other of said support legs opposite the disc side of said support base for compensating for the weight on said support base with a hose wound on said disc.

5. Apparatus as defined in claim 1 including control means located at the feed side of said disc for selectively operating said drive means.

6. Apparatus as defined in claim 1 wherein said drive means includes an electric motor coupled to said winding disc.

7. Apparatus as defined in claim 6 wherein said electric motor is operated by a food pedal disposed on the feed side of said disc.

8. Apparatus as defined in claim 1 wherein said first support member comprises a flat plate and said second support member comprises a cylindrical pin, said plate and pin each having a uniform cross section throughout the lengthwise extent thereof.

9. Apparatus as defined in claim 1 wherein said disc is mounted on a support base attached to four support legs mounted on casters.

10. Apparatus as defined in claim 1 wherein said drive means includes an electric motor coupled through a reducing gear box to said disc.

11. Apparatus as defined in claim 1 including a support base for supporting said disc and a handle attached to said support base for moving and positioning said support base.

12. Apparatus as set forth in claim 1 wherein said second selected distance is greater than said first selected distance.

13. Apparatus for coiling a hose assembly or the like including a generally cylindrical coupling with a sidewall and an end to which a hose is attached, said apparatus comprising:

a support base having four support legs;

a generally circular winding disc with a substantially flat surface portion mounted for rotation about a generally horizontal rotational axis and having a feed side;

first and second support members attached to and projecting away from said surface portion, said first support member being in the form of a generally rectangular flat support plate and having a flat support surface spaced a first selected distance away from and arranged substantially parallel to a first reference line in the plane of said surface portion passing through said axis to provide a shelf-like support on which the sidewall of the coupling is positioned for support, said first support member projecting away from and substantially delimited in extent in one direction to a second reference line perpendicular to said first reference line in the plane of said surface portion and passing through said axis, said second support member being in the form of a generally cylindrical pin spaced a second selected distance greater than said first selected distance away from said axis along said first reference line and on the opposite side of said first reference line from that of said support surface to provide a stop for the end of the coupling to which the hose is attached and so that said support members form an essentially right-angle seat for the sidewall and end of the coupling, said first support member leading said second support member with said disc rotated in a direction so that said feed side of said disc moves downwardly to wrap fro- the bottom of a coil of said hose being formed during the rotation of said disc, whereby, when the coupling is placed on said support surface and the hose extends between said first and second support members, as soon as a pull is exerted on said hose due to the rotation of said disc, said coupling becomes seated in said seat and is held firmly in a right-angle supported position by said support members and said hose first wraps around said second support member, around said coupling and then around said first support member and is guided along said surface portion to form a flat coil;

an electric motor coupled through a reducing gear box to said disc for rotating said disc; and a foot pedal on the feed side of the disc for selectively operating said electric motor.

* * * * *